US006677905B2

(12) United States Patent
Deguchi et al.

(10) Patent No.: US 6,677,905 B2
(45) Date of Patent: Jan. 13, 2004

(54) ANTENNA DEVICE AND MOBILE COMMUNICATIONS APPARATUS INCLUDING THE DEVICE

(75) Inventors: Futoshi Deguchi, Fukuoka (JP); Toshinori Komesu, Fukuoka (JP); Akihiko Hirata, Fukuoka (JP); Sumio Tate, Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/075,572

(22) Filed: Feb. 13, 2002

(65) Prior Publication Data

US 2003/0016177 A1 Jan. 23, 2003

(30) Foreign Application Priority Data

Jul. 18, 2001 (JP) ..... 2001-217785
Aug. 17, 2001 (JP) ..... 2001-247965
Aug. 31, 2001 (JP) ..... 2001-263267

(51) Int. Cl.[7] ..... H01Q 9/18
(52) U.S. Cl. ..... 343/702; 343/825; 343/856
(58) Field of Search ..... 343/702, 895, 343/825, 846, 713, 856, 864

(56) References Cited

U.S. PATENT DOCUMENTS 4,259,673 A * 3/1981 Guretzky ..... 343/825
5,406,295 A * 4/1995 Baranski et al. ..... 343/713
5,995,064 A * 11/1999 Yanagisawa et al. ..... 343/895
6,441,791 B1 * 8/2002 Oka ..... 343/713

FOREIGN PATENT DOCUMENTS

JP 6-232622 8/1994
JP 10-313205 11/1998

* cited by examiner

*Primary Examiner*—James Clinger
*Assistant Examiner*—D. Brown
(74) *Attorney, Agent, or Firm*—RatnerPrestia

(57) ABSTRACT

An antenna device includes: a radiator having a meander portion; and a conductor shorter than the radiator which is disposed opposite to the radiator. A coaxial cable is connected to the radiator and conductor. Respective line lengths of the radiator and conductor satisfy a predetermined relation with respect to a wavelength of a signal to be transmitted and received. The antenna device achieves at least one of improved antenna characteristics, downsizing, and improved mechanical strength.

85 Claims, 23 Drawing Sheets

ANTENNA DEVICE AND MOBILE COMMUNICATIONS APPARATUS INCLUDING THE DEVICE

FIELD OF THE INVENTION

The present invention relates to an antenna device for a mobile communication apparatus such as a mobile phone, PHS, cordless handset, and mobile data communications device, and to a mobile communication apparatus including the antenna device.

BACKGROUND OF THE INVENTION

FIG. 21 and FIG. 22 are perspective views of mobile communication apparatuses equipped with conventional antenna devices, respectively. Mobile communication apparatuses 100 and 102 are equipped with respective antenna devices 101 and 103. The antenna device 101 is made from of a helical conductive wire, and the antenna device 102 is made from a linear conductive wire.

Since the conventional antenna device emits radio waves isotropically, about the device, a head of a user impedes the emitted radio waves when the user brings the mobile communication apparatus to his/her ear during using the apparatus. This reduces overall radiating efficiency of the device.

These conventional antenna devices are disclosed in the Japanese Laid-Open Patent Nos. 6-232622 and 10-313205.

SUMMARY OF THE INVENTION

An antenna device includes a radiator having a line length (L1) and a conductor having a line length (L2) smaller than the line length of the radiator. The conductor is disposed oppose to the radiator. Each line length satisfies the following formula:

$$L1=0.75\lambda\pm0.2\lambda;$$

and $$L2=0.25\lambda\pm0.2\lambda,$$

where λ is a wavelength of a signal applied to the radiator.

BRIEF DESCRIPTION OF THE DRAWINGS

FIGS. 18A and 18B illustrate the antenna device in accordance with the second embodiment.

DETAILED DESCRIPTION OF PREFERRED EMBODIMENT

First Exemplary Embodiment

Figure 1A:
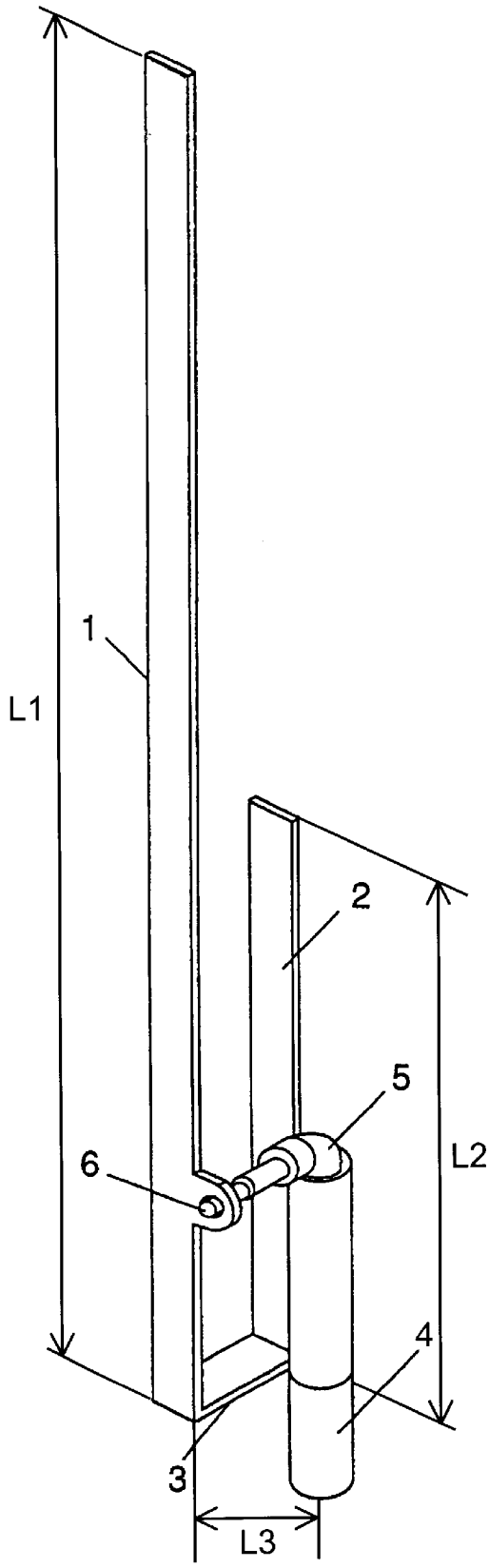
FIG. 1A is a perspective view of an antenna device in accordance with a first exemplary embodiment of the present invention.
Figure 1B:
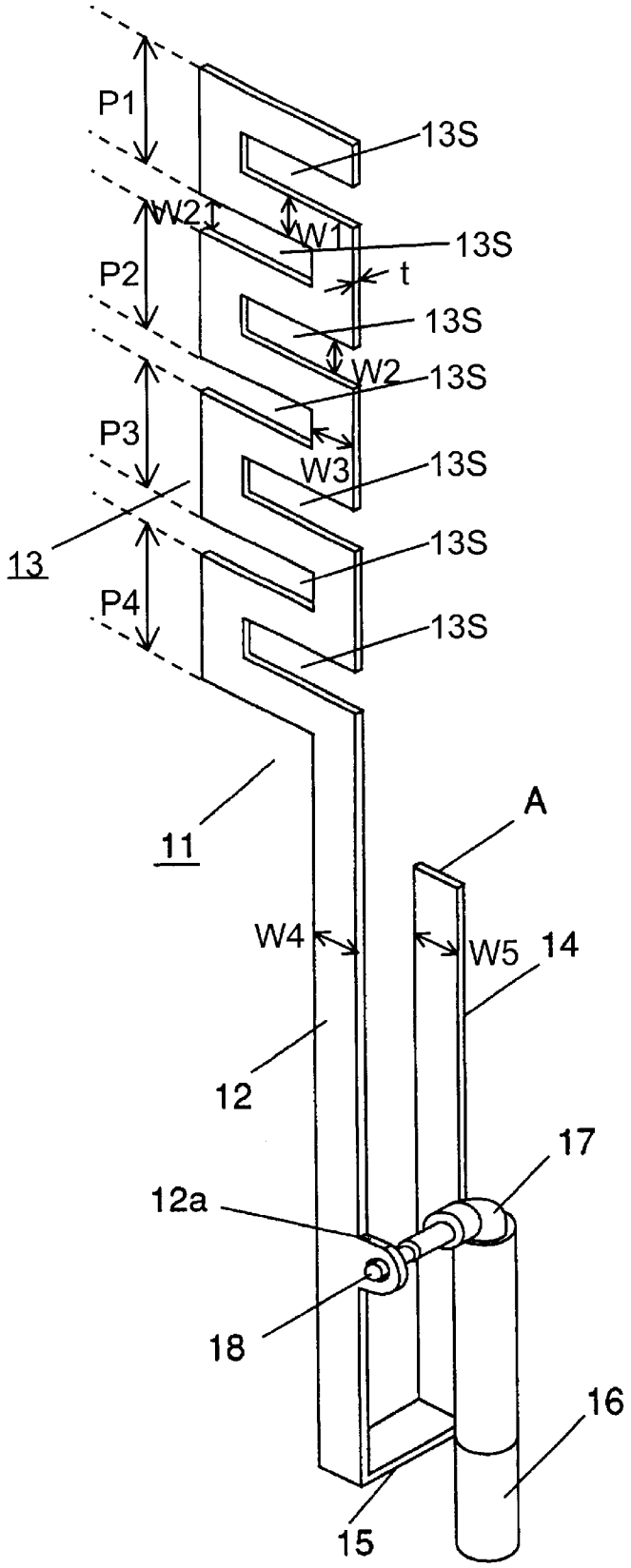
FIG. 1B is a perspective view of the antenna device in accordance with the first embodiment.
Figure 2:
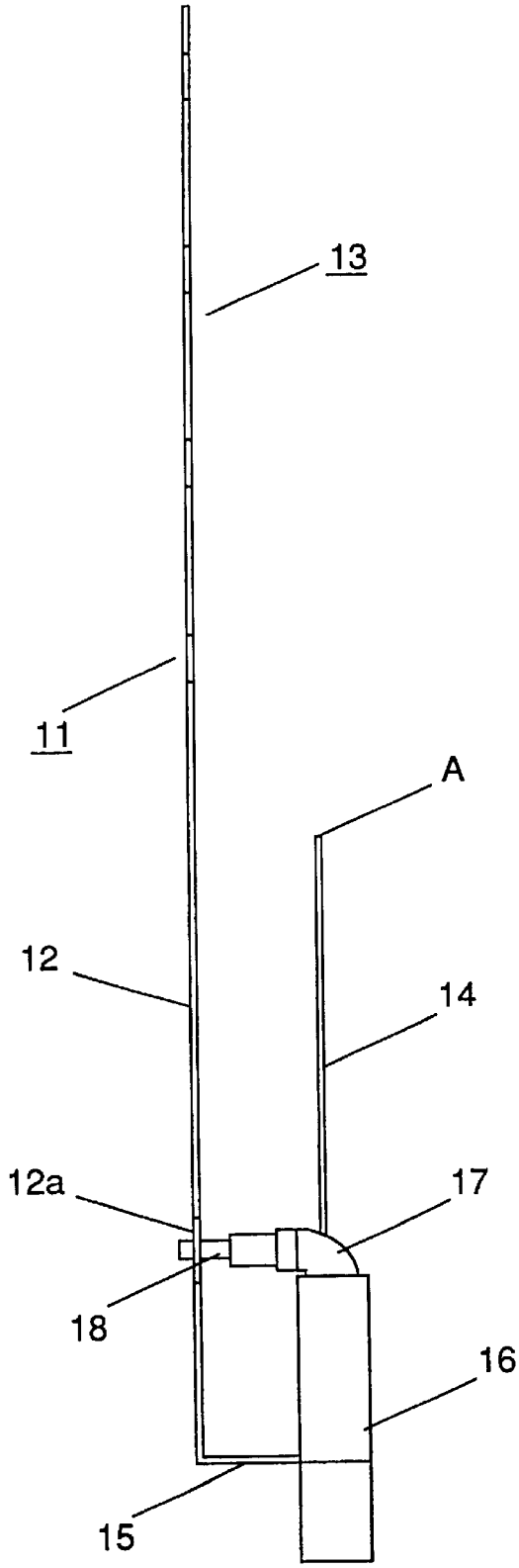
FIG. 2 is a side view of the antenna device in accordance with the first embodiment.

FIG. 1A and FIG. 1B are perspective views of an antenna device according to a first exemplary embodiment of the present invention. FIG. 2 is a side view of the antenna device. In FIG. 1A, a radiator 1 and a matching stub 2 are connected with a coupler 3. A grounding line 5 of a coaxial cable 4 is bonded to the matching stub 2, for example, by soldering. A feed line 6 is bonded to the radiator 1, for example, by soldering. The matching stub 2 may be a conductor having other functions.

An antenna element is formed through punching a conductive plate such as a metal sheet to unitarily form the radiator 1, the coupler 3, and the matching stub 2.

A line length L1 of the radiator 1 from the coupler 3 is larger than a line length L2 of the matching stub 2 from the coupler 3. The line lengths preferably satisfy the following relation with respect to a wavelength λ of a received or transmitted signal with the antenna device and a line length L3 of the coupler 3.

$$L1=0.75\lambda\pm0.2\lambda$$

$$L2=0.25\lambda\pm0.2\lambda$$

$$\lambda/150\leqq L3\leqq\lambda/10$$

With the line length of each member satisfying the above relation, a current phase between the matching stub 2 and a portion opposite to the matching stub 2 in the radiator 1 can be imbalanced. Further, the length allows the antenna device to have a directivity and to control a radiating elevation angle. The device has improved characteristics, upon satisfying the above relation where the wavelength λ is 400 mm or less, and preferably is 350 mm or less.

Another antenna device in the first embodiment will be described below. In FIG. 1B and FIG. 2, a radiator 11 includes a straight portion 12 and a meander portion 13 having a zigzag shape provided at the tip of the straight portion 12. A matching stub 14 and the radiator 11 are connected with a coupler 15. Both ends of the coupler 15 where the radiator 11 and the matching stub 14 are unitarily formed are bent in the same direction substantially perpendicular to the coupler 15 so as to form the radiator 11 and matching stub 14.

The antenna element, for example, is made through punching a metal sheet into a strip having a meander portion 13 at its tip. Then, both ends of the coupler 15 having a predetermined length in a middle of the strip are bent in the same direction to complete the antenna element. This process enables the antenna device to be manufactured at extremely excellent productivity. The strip of the metal sheet is composed mainly of Fe. The surface of the strip may be plated with a predetermined plating film. The metal sheet may be a conductive metal sheet such as copper plate or aluminum plate. A material suitable for bending should be selected for reasons of workability and cost. More preferably, the sheet may be made of a single metal or be coated with one or more thin films for improving bondability or corrosion resistance. The antenna device may be made from a single sheet of metal, but may be made metal sheets of the same or different materials bonded to each other. An insulating resin or ceramic sheet having a surface coated with a thin conductive film may be used instead of the metal sheet.

The meander portion 13 may be made from a punched metal sheet. Alternatively, the portion may be made through forming a mask having a predetermined shape on the metal sheet and then removing an unneeded portion of the sheet by etching and so on.

The metal sheet may be formed through stamping a wire or bar-shaped piece of metal. In this case, a part of the metal wire or bar which becomes the meander portion 13 is bent to a zigzag shape in advance, and then stamped typically by pressing.

Elements such as the radiator 11 in the first embodiment are formed from a metal sheet. However, they may be formed from a bent wire or bar-shaped materials.

The meander portion 13, since having a zigzag shape, allows the radiator 11 shorter, thus facilitating downsizing of the antenna element. In addition, the meander portion 13 having the zigzag shape is mechanically robust, and is hardly deformed by an external force. The zigzag shape leads to improved resilience, which strengthens recoverability, enabling a rapid return to its original shape.

The meander portion 13 becomes a current antinode (a point carrying a local-maximum current) of the antenna element. Since the current antinode appears at an upper part, the antenna element can transmit radio waves efficiently.

A coaxial cable 16 has one end connected to the antenna element, and has the other end electrically coupled to an internal circuitry of a mobile terminal. The coaxial cable 16 is disposed at the side of the antenna element. A grounding line 17 at the outside of the coaxial cable 16 is bonded to the side of the middle of the matching stub 14. A feed line 18 at the inside of the coaxial cable 16 is electrically coupled to a joint 12*a* unitarily provided at the side of the straight portion 12, with bonding material such as solder. As shown in the Figure, the feed line 18 may be passed via a through-hole in joint 12*a*, thus enabling to be bonded efficiently and firmly with solder. The joint 12*a* is not necessary if the feed line 18 is directly bonded onto the straight portion 12.

The matching stub 14 may has the same shape as a portion, of the radiator 11, opposite to the matching stub. Since the straight portion 12 according to the first embodiment is a straight strip, the matching stub 14 may be a strip. This cancels radio waves and matches an impedance at the feeding section through forming a current flow to the matching stub 14 in a direction opposite to a flow to the radiator 11.

Accordingly, the straight portion 12 is preferably longer than the matching stub 14; and the meander portion 13 and the matching stub 14 preferably do not face directly to each other. In other words, the meander portion 13 is preferably disposed at a place above a tip A of the matching stub 14. Since the matching stub 14 is a straight strip as aforementioned, the direction of current flow in the stub does not reverse if the matching stub 14 directly faces to the meander portion 13. This results in an inability to cancel an electric field of each element. In this state, the required characteristics are not achievable. Required antenna radiating characteristics may be obtained through optimizing the line length of the straight portion 12, matching stub 14, and coupler 15 and through adjusting the line lengths as follows, so that the electric field of each element may not be mutually cancelled.

(Line length of the radiator 11)=0.75λ±0.2λ

(Line length of the matching stub 14)=0.25λ±0.2λ

λ/150≦(Line length of the coupler 15)≦λ/10

In FIG. 1B, the line length of the radiator 11 is not equal to the height of the radiator 11 since the radiator 11 has the meander portion. The line length of the radiator 11 is equal to the sum of respective lengths of the straight portion 12 and the meander portion 13. The length of the meander portion 13 is the sum of the height of the zigzag portion (the length in a direction of widths W1 and W2) and the widthwise length (the length in a direction of a width W3).

In the above relation, a phase of currents in the straight portion 12, matching stub 14, and coupler 15 are adjusted with respect to the front-back (FB) ratio and a radiating elevation angle of radio waves emitted from the antenna device, while matching the impedance. In this case, the matching stub 14 may have has the same shape as a portion, of the radiator opposite to the matching stub 14.

In FIG. 1A and FIG. 1B, the antenna element, upon being made of a sheet such as metal sheet, may have a thickness preferably ranging from 0.1 mm to 3.0 mm, and more preferably ranging from 0.3 mm to 0.7 mm. The strength of the antenna element is not sufficient if being is thinner than 0.1 mm. The antenna element, upon being thicker than 3.0 mm, is hardly downsized and is manufactured less efficiently due to difficulties in bending and punching.

In the first embodiment, the width W1 of the horizontal part and the width W3 of the vertical part of the meander portion 13, the width W4 of the straight portion 12, and the width W5 of the matching stub 14 are all substantially identical to each other. However, at least one of the widths may be different in order to meet specifications, to adjust characteristics, or to secure physical strength.

Each width, regardless of their mutual relationship, may preferably ranges from 0.5 mm to 6.0 mm. A width smaller than 0.5 mm is unsatisfactory with respect to mechanical strength and characteristics. A width greater than 6.0 mm allows the antenna element to be large and causes loss of productivity due to difficulties in bending and punching.

The width W2 of slits 13S in the meander portion 13 is substantially identical to each other. However, one of the slits 13S may have a different width from other slits 13S. The width W2 of each slit 3S is preferably 0.8 to 3 times of the widths W1 and W3, regardless of mutual relationship. The slit 13S, upon having a width smaller than 0.8 times of the widths, makes metal sheets approach too close to each other and causes coupling to the sheets, which results in degradation of characteristics. If the slit 13S is wider than 3 times of the widths, the antenna element itself becomes large. If the widths W1 and W3 are not substantially identical, the width W2 of the slit 13S is determined with reference to width W1.

As shown in FIG. 1B, a substantially U-shaped meander portion 13 has a zigzag shape having widths P1, P2, P3, and P4 being substantially identical to each other. However, at least one of these widths may be different from the others in order to meet specifications or adjust characteristics. In this embodiment, the meander portion 13 has four U-shaped curves having the widths P1, P2, P3, and P4, respectively. The meander portion 13 may preferably have one through nine substantially-U-shaped curves. The meander portion, upon having more than nine U-shape curves, makes the antenna element too large.

Second Exemplary Embodiment

Figure 3:
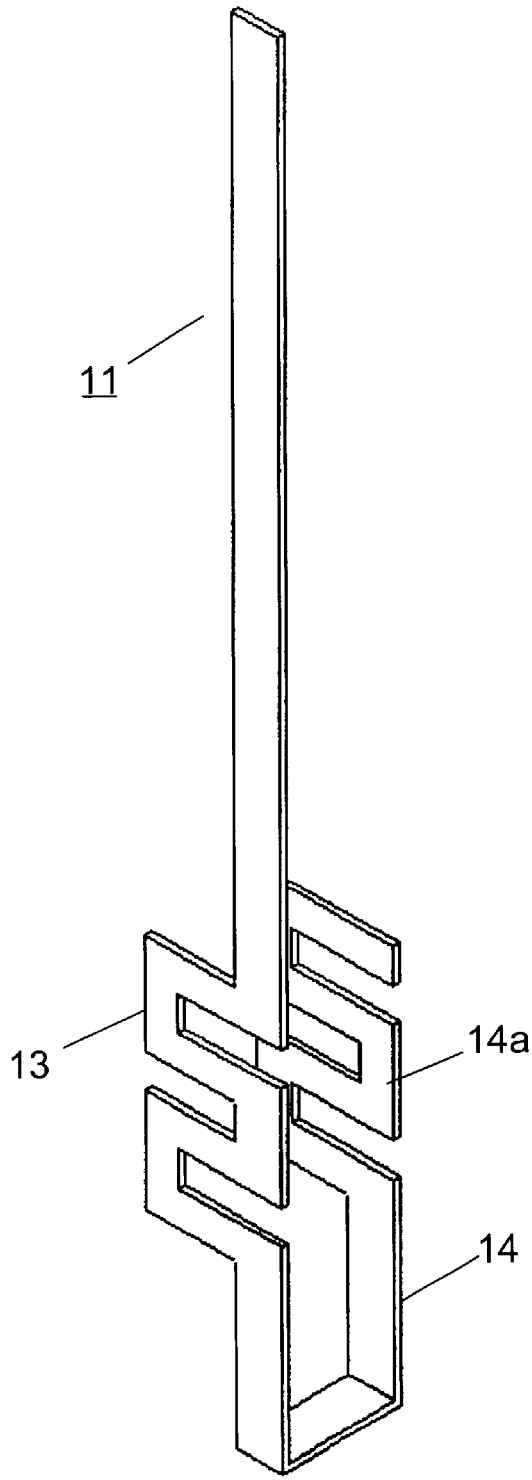
FIG. 3 is a perspective view of an antenna element in accordance with a second exemplary embodiment of the present invention.

FIG. 3 shows an antenna device according to a second exemplary embodiment. A meander portion 13 is provided in the middle of a radiator 11. A meander portion 14*a* is provided in the matching stub 14 at a position corresponding to the meander portion 13. This allows the current in the meander portion 13 and meander portion 14*a* to flow in opposite phase to each other, thus resulting in canceling and therefore preventing radio waves from being emitted. As a result, an impedance around a feeding point, the lowest point in the antenna element, decreases to match with the impedance of a circuit. In addition, the straight radiator allows the antenna device to be downsized without decreasing its radiating efficiency. The width relation shown in FIG. 1B and the number of substantially-U-shaped curves described in the first embodiment are applicable to the meander portions 13 and 14*a*.

Figure 4:
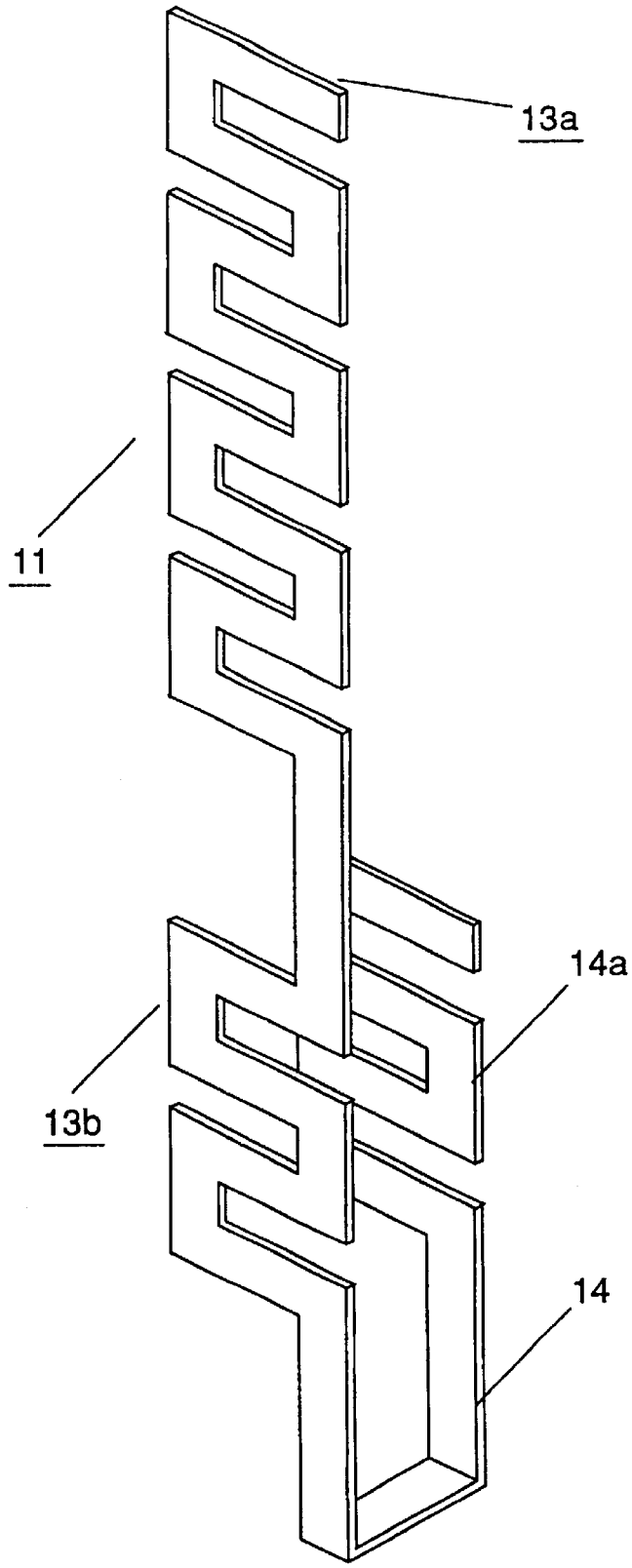
FIG. 4 is a perspective view of the antenna element in accordance with the second embodiment.
Figure 5:
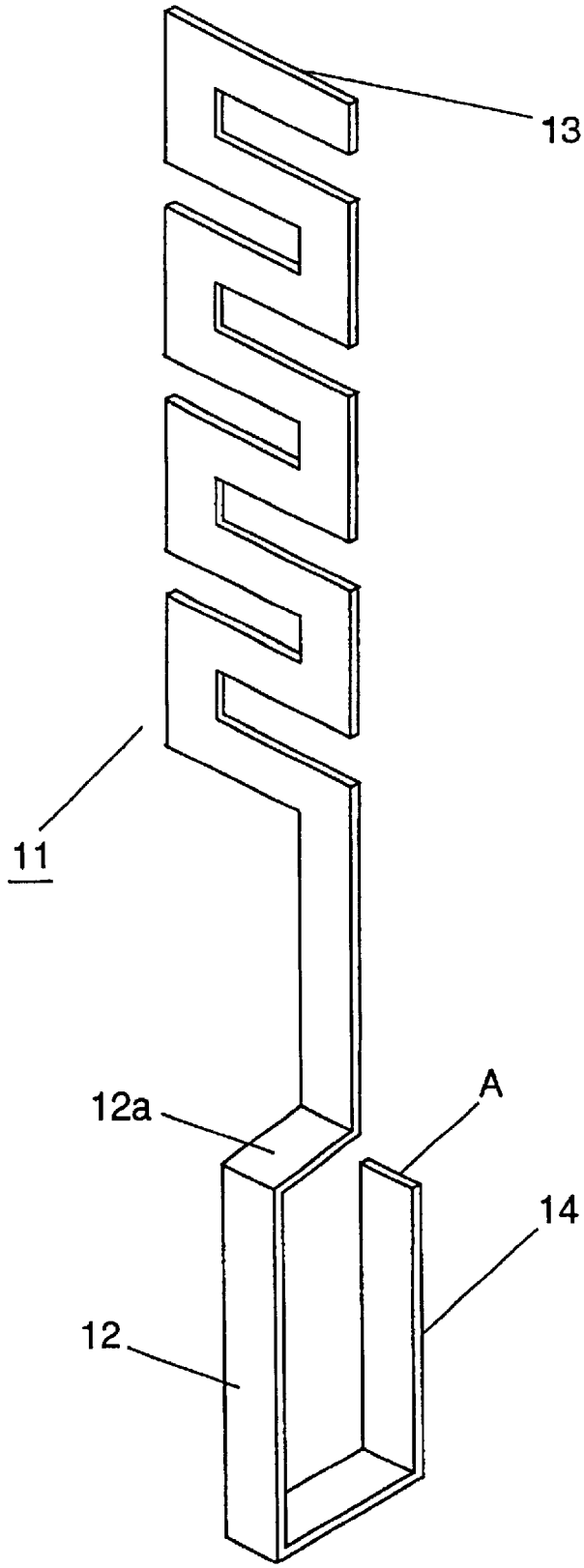
FIG. 5 is a perspective view of the antenna element in accordance with the second embodiment.

FIG. 4 shows an antenna element which has meander portions 13*a* and 13*b* at the tip and middle of the radiator 11 and which has the meander portion 14*a* in the matching stub 14. As shown in FIG. 4, the radiator 11 may have two or more meander portions. This structure allows a smaller antenna device than the device shown in FIG. 3 to be produced. The width relation shown in FIG. 1B and the number of substantially-U-shaped curves described in the first embodiment are applicable to each of the three meander portions As shown in FIG. 5, the straight portion 12 may have a bent section 12*a* to locate the meander portion 13 closer to the matching stub 14. The bent section 12*a* may be preferably provided above a tip A of the matching stub 14. When a user brings a cordless telephone including the antenna device to an ear during using the telephone, the radiator 11 is normally located near his/her head, and the matching stub 14 is located away from the head. The structure shown in FIG. 5 allows the meander portion 13 of the radiator 11 to be located further from the head, an obstacle, thus suppressing degradation of radiating and other characteristics.

Figure 6:
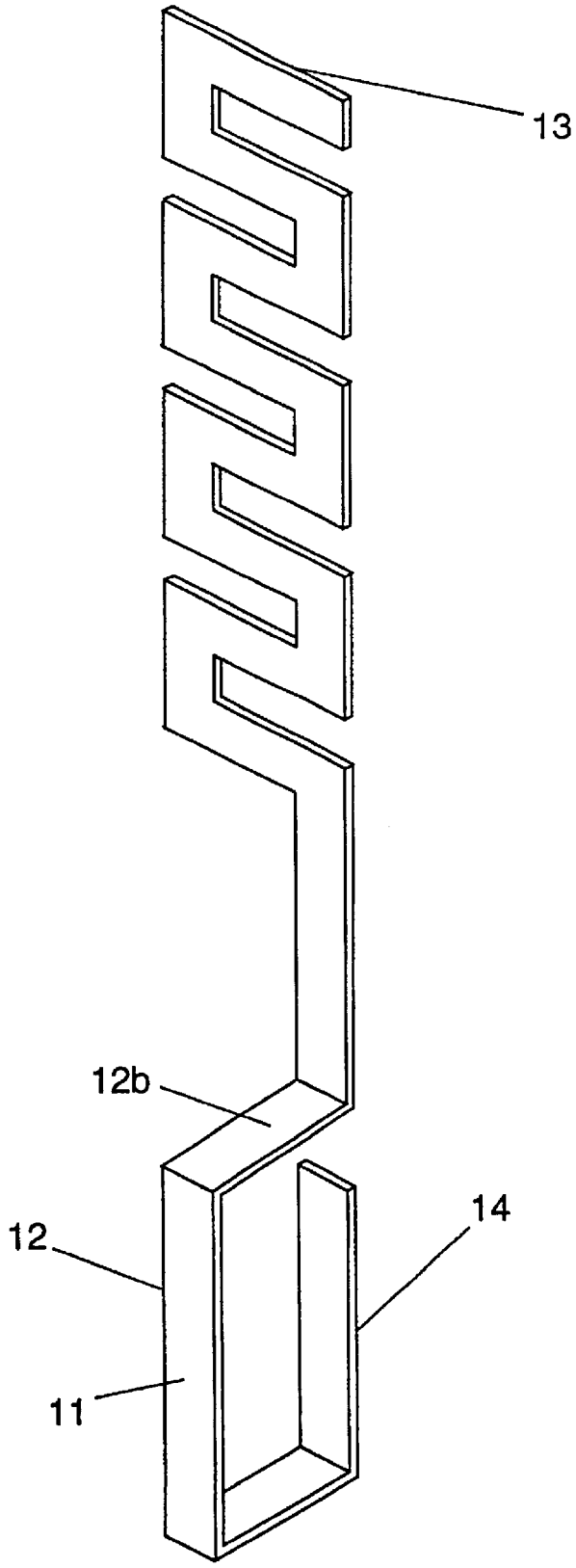
FIG. 6 is a perspective view of the antenna element in accordance with the second embodiment.
Figure 7:
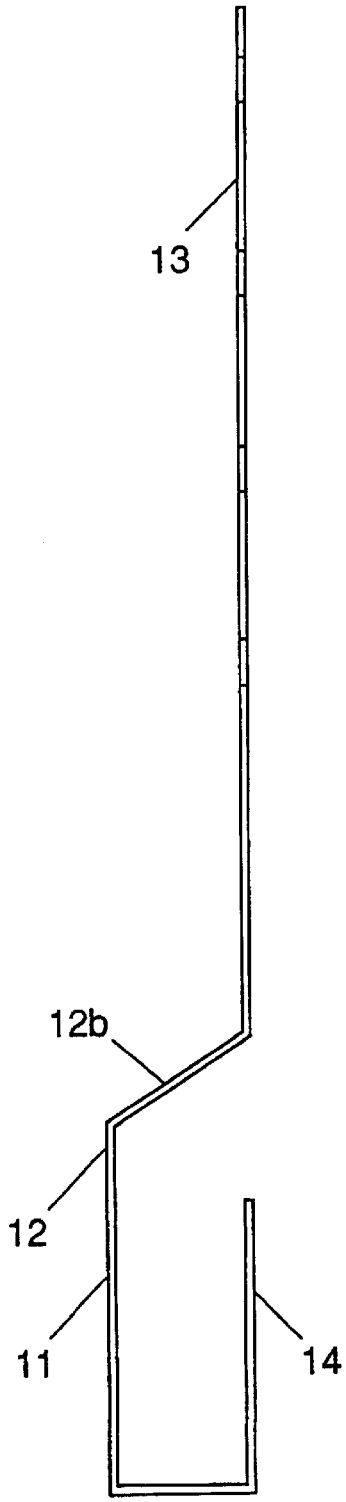
FIG. 7 is a side view of the antenna element in accordance with the second embodiment.

FIG. 6 and FIG. 7 show another antenna element than in FIG. 5. The meander portion 13 is disposed in an imaginary plane formed with the matching stub 14. The antenna element shown in FIG. 5 features the meander portion 13 positioned above the coupler 15 between the matching stub 14 and the straight portion 12. The antenna element shown in FIG. 6 and FIG. 7 allows the meander portion 13 to be located further away from the head, thus further reducing the degradation of radiating characteristics.

Figure 8:
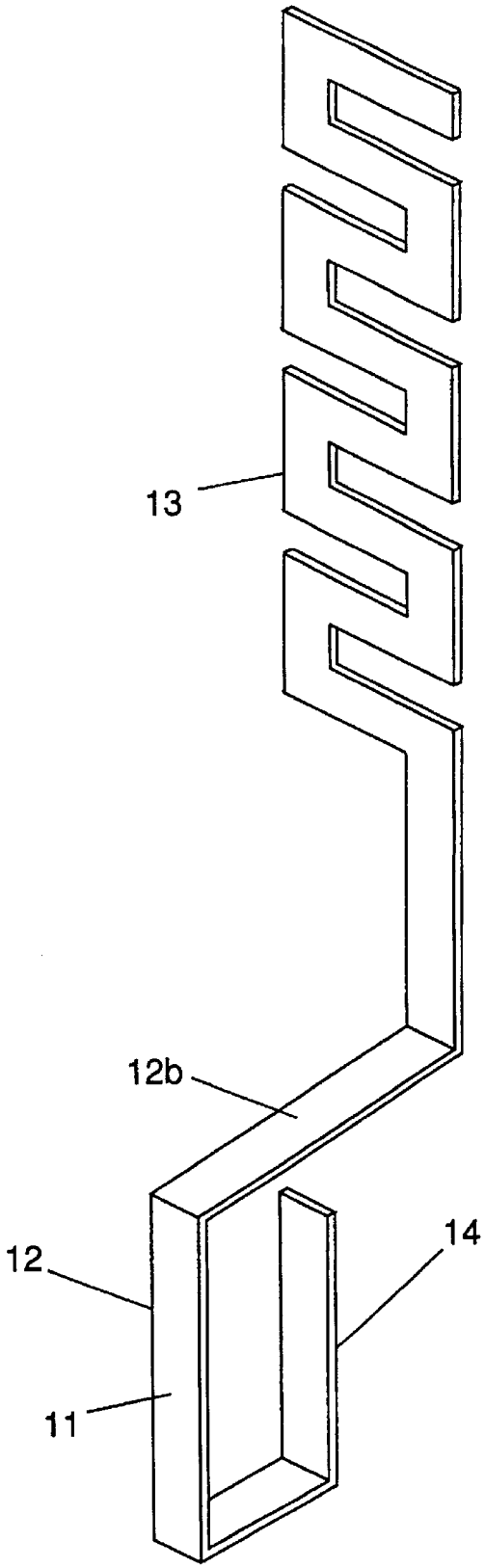
FIG. 8 is a perspective view of the antenna element in accordance with the second embodiment.
Figure 9:
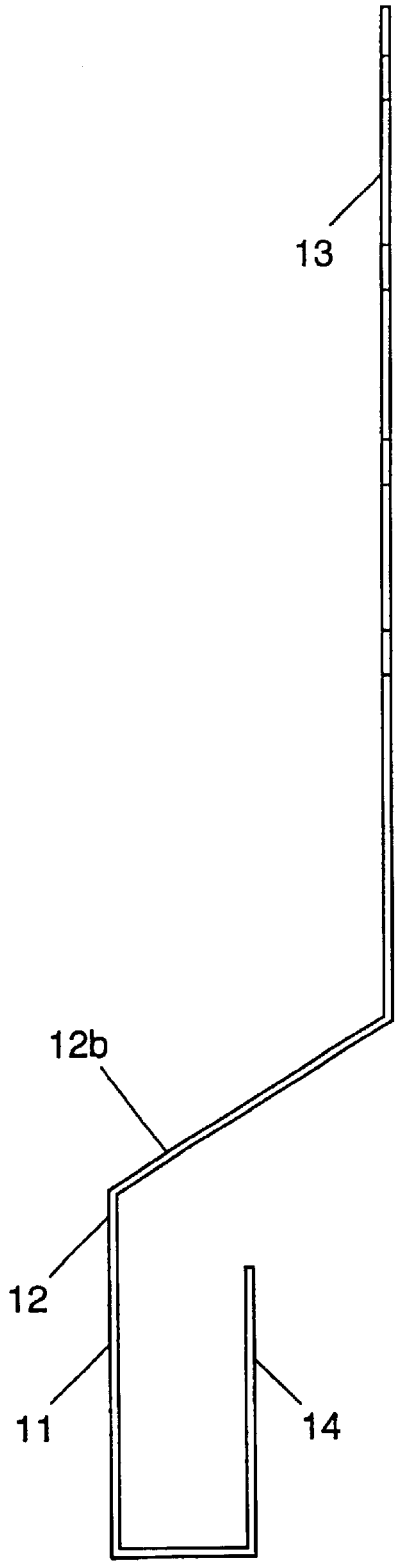
FIG. 9 is a side view of the antenna element in accordance with the second embodiment.

In FIG. 8 and FIG. 9, the meander portion 13 is disposed at a position exceeding the matching stub 14 and not facing to the coupler 15. This structure further improves the radiating characteristics of the antenna element.

Figure 10B:
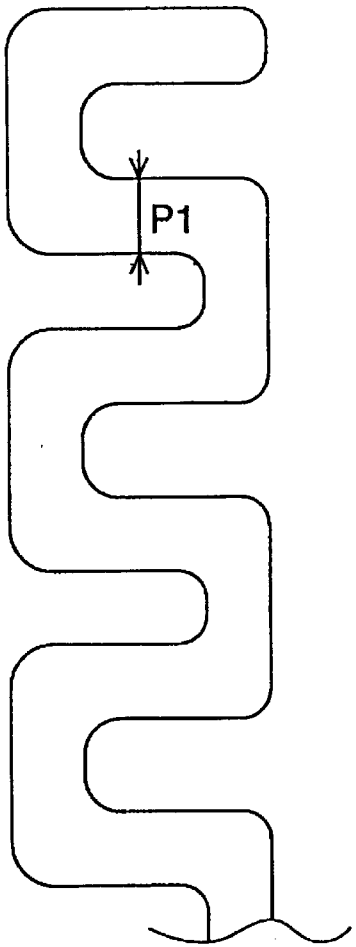
FIG. 10A and FIG. 10B are plan views of the antenna element in accordance with the second embodiment.
Figure 10A:
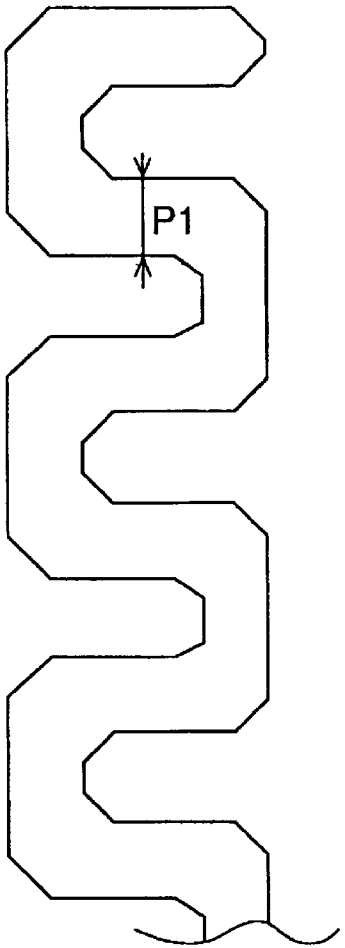

A corner of at least one of the meander portions in the radiator 11 and the matching stub 14 may be chamfered as shown in FIG. 10A, or chamfered in round shape as shown in FIG. 10B. The corner of the meander portion has a potential to function as a capacitor. Therefore, the total of the capacitances increases as more meander portions are provided, thus changing a resonance frequency of the antenna element. In this state, the antenna element can be hardly matched design-wise. In addition, radiating efficiency decreases. The corner may be chamfered in round shape preferably having a radius R preferably less than the line width P1 of the meander portion. Actually, the radius R ranges from 0.5 mm to the line width P1. Alternatively, the corner is chamfered so that the element may exhibit equivalent effect to that being chamfered in round shape.

Figure 11B:
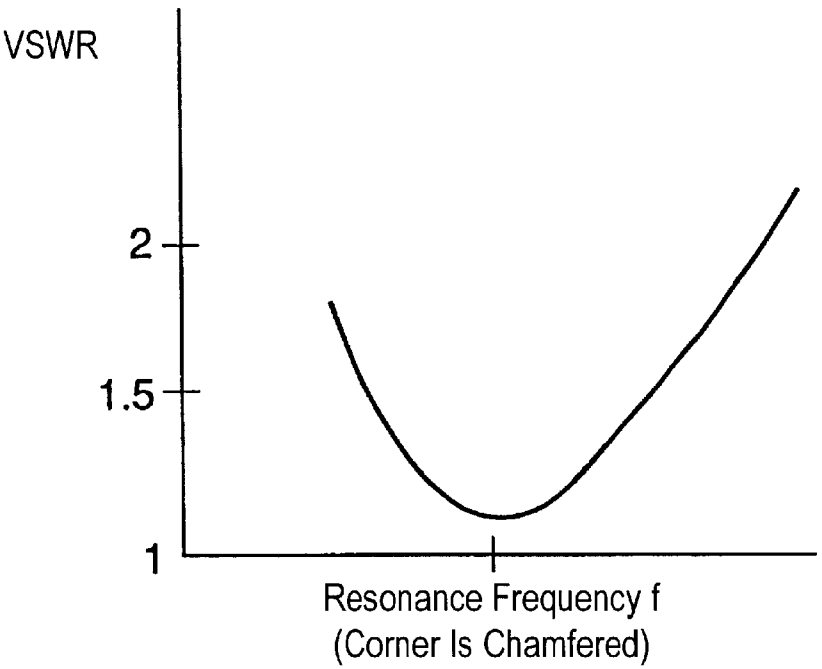
FIG. 11A and FIG. 11B illustrate the relation between a resonance frequency and a voltage standing wave ratio (VSWR) of an antenna device in accordance with the second embodiment.
Figure 11A:
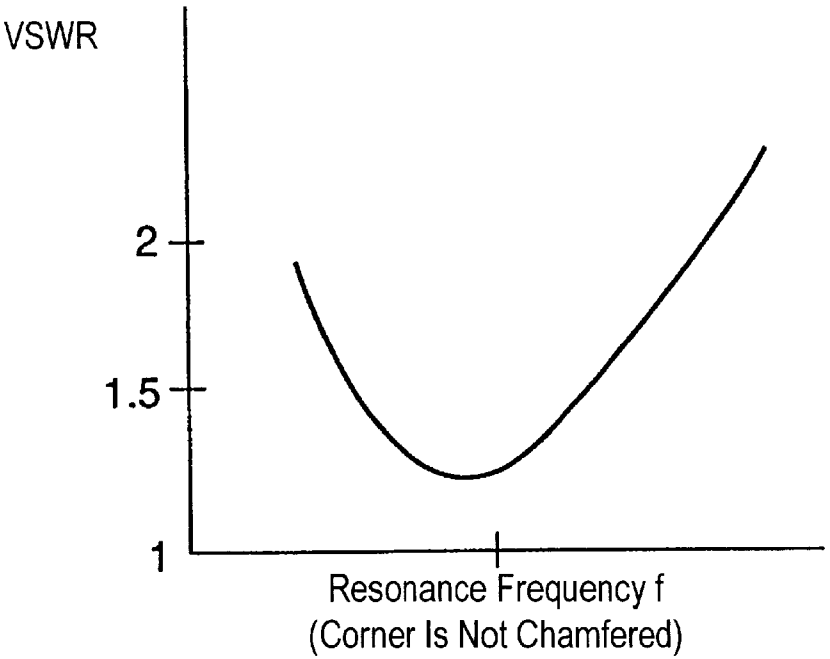

FIG. 11A and FIG. 11B show the relationship between a resonance frequency and a voltage standing wave ratio (VSWR) of the antenna element in the second embodiment, respectively. FIG. 11A shows the characteristics of the antenna element without the chamfered corner of the meander portion. FIG. 11B shows the antenna characteristics of the antenna element with the chamfered corner of the meander portion. The antenna element with the chamfered corner of the meander portion exhibits the minimum or close to minimum VSWR at the resonance frequency, thus being allowed to match to a radio circuit in a mobile communication apparatus. Accordingly, the antenna element has the maximum performance conducted to improve both radiating efficiency and receiving performance of the radio circuit. In this embodiment, all corners of the meander portion may be chamfered. It is preferable to chamfer half or more of all the corners on the meander portion. The corner may be chamfered through cutting a sharp corner or through punching a metal sheet in a shape having a corner chamfered in advance.

Figure 12:
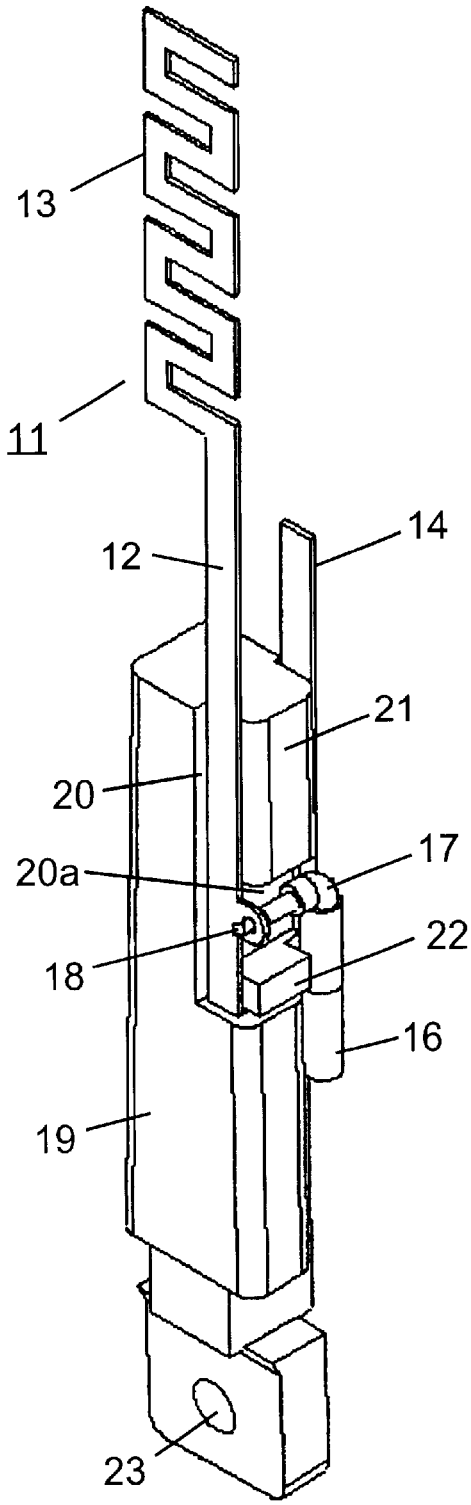
FIG. 12 is a perspective view of the antenna device in accordance with the second embodiment.
Figure 13:
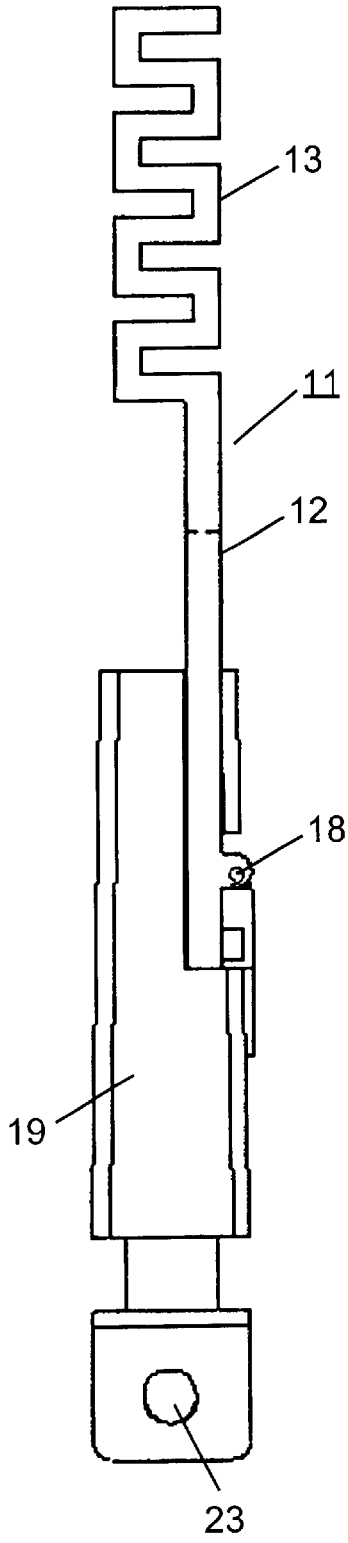
FIG. 13 is a front view of the antenna device in accordance with the second embodiment.
Figure 14:
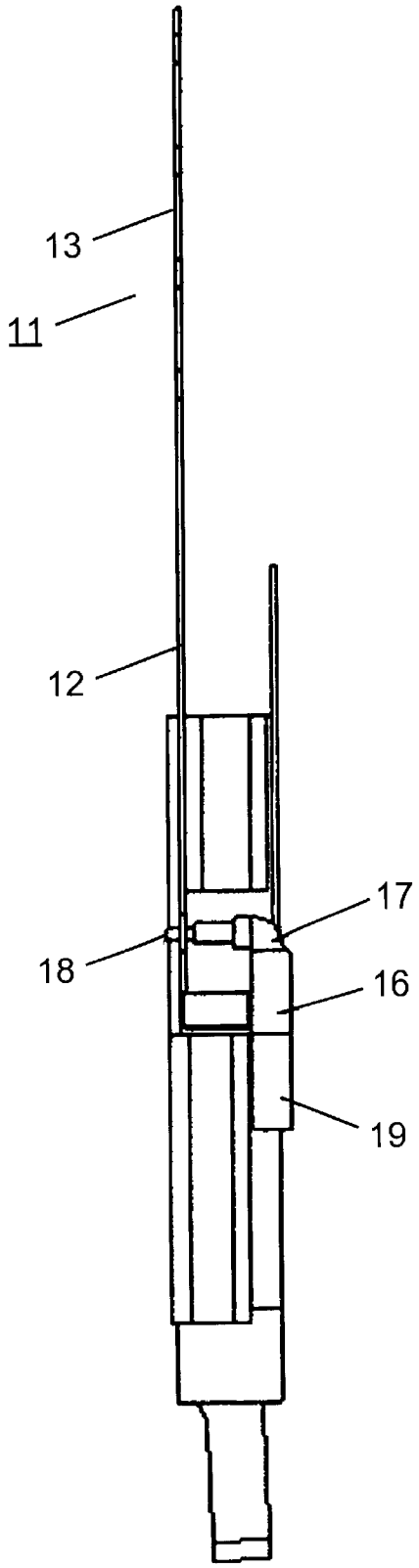
FIG. 14 is a side view of the antenna device in accordance with the second embodiment.

As shown in FIG. 12 to FIG. 14, the antenna element may be accommodated in a holder 19. The holder 19 is provided with a cavity 20 or a groove fitting to the substantially-J-shaped antenna element. The antenna element is accommodated to the cavity 20 and secured to the holder 19 typically with adhesive. Protrusions 21 and 22, parts of the holder 19, are provided between the matching stub 14 and the radiator 11, and the cavity 20 or the groove is provided between the protrusions 21, 22 and other portions. The holder 19, upon being made of insulating material, preferably resin such as ABS resin and elastomer, can be formed easily. A screw is inserted into a through hole 23 at the end of the holder 19 for securing the holder 19 onto a circuit board of a communication apparatus. The coaxial cable 16 has one end accommodated in a cavity 20*a* between the protrusions 21 and 22, so that the straight portion 12 and the matching stub 14 may be electrically coupled to the coaxial cable 16, and that the coaxial cable may not protrudes from the holder 19. This permits the antenna device to be downsized.

Figure 15:
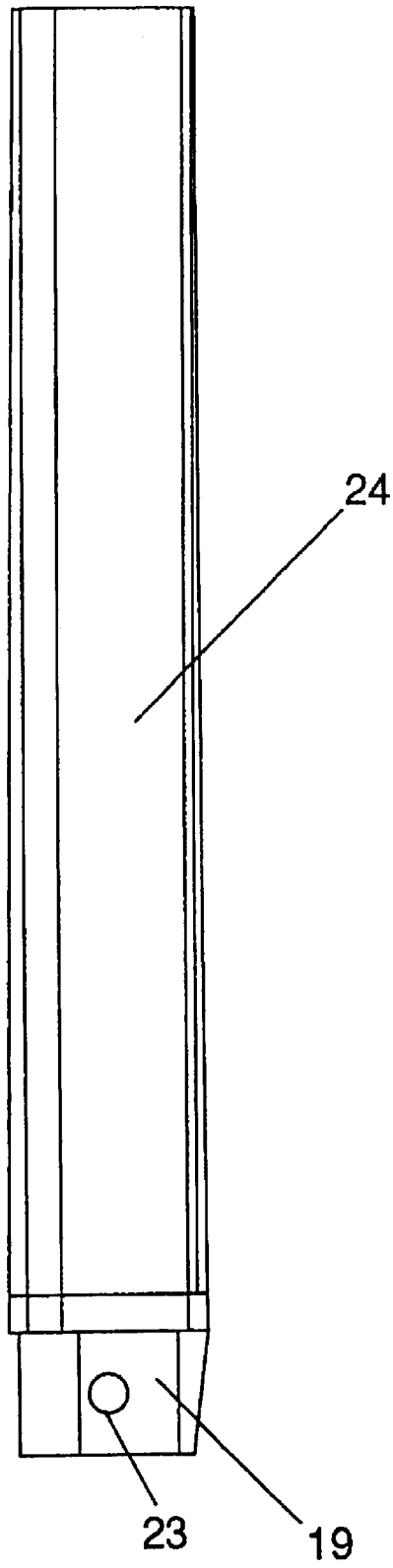
FIG. 15 is a front view of the antenna device in accordance with the second embodiment.

The antenna element attached to the holder 19, upon inserted into a resin radome 24 as shown in FIG. 15, has improved weather resistance and mechanical strength. The chamfered corner of the meander portion, as described above, prevents characteristics from being degraded due to dust generated by shedding of fragments of the radome 24 as a result of a contact between the corner and the radome 24 caused by internal vibration.

Figure 16A:
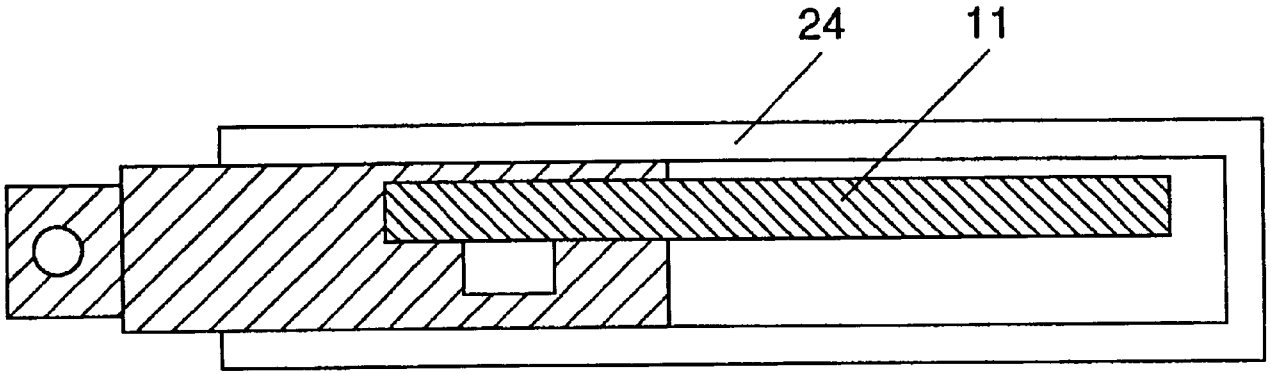
FIGS. 16A and 16B illustrate the antenna device in accordance with the second embodiment.
Figure 16B:
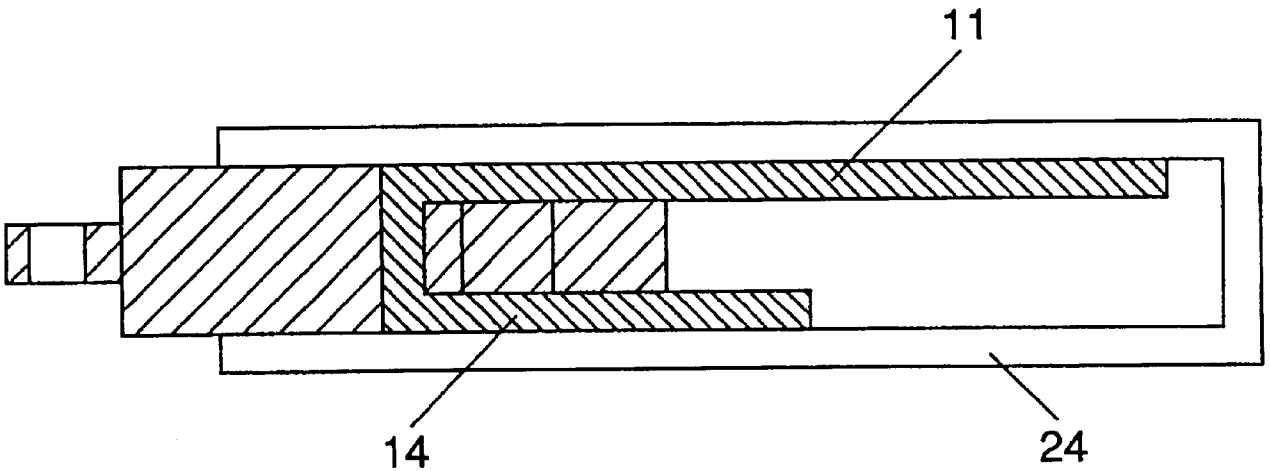

As shown in FIG. 16A and FIG. 16B, the antenna element attached to the holder 19 is inserted into the radome 24 while respective main surfaces of the radiator 11 and the matching stub 14 contact the radome 24. This allows the radiator 11 and the matching stub 14 to be securely attached in the radome 24, thus suppressing variation in characteristics.

Figure 17A:
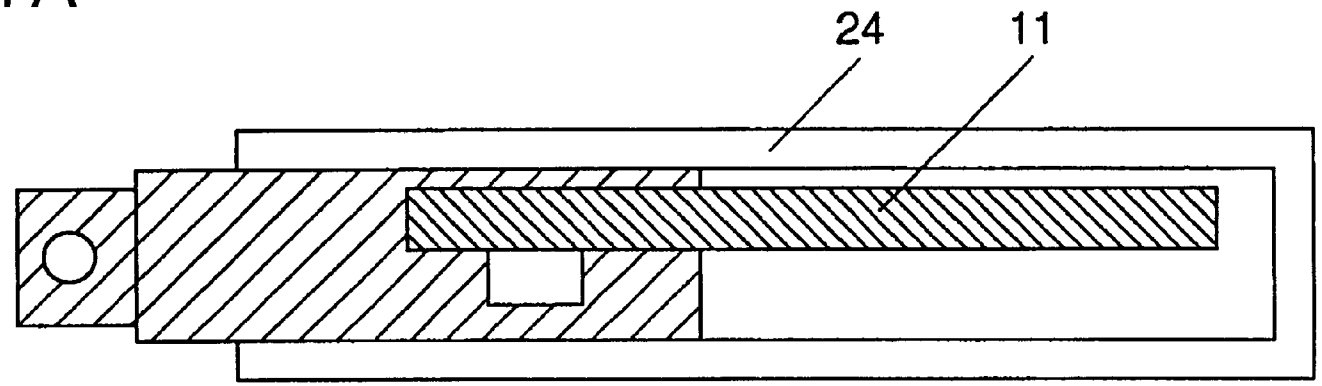
FIGS. 17A and 18B illustrate the antenna device in accordance with the second embodiment.
Figure 17B:
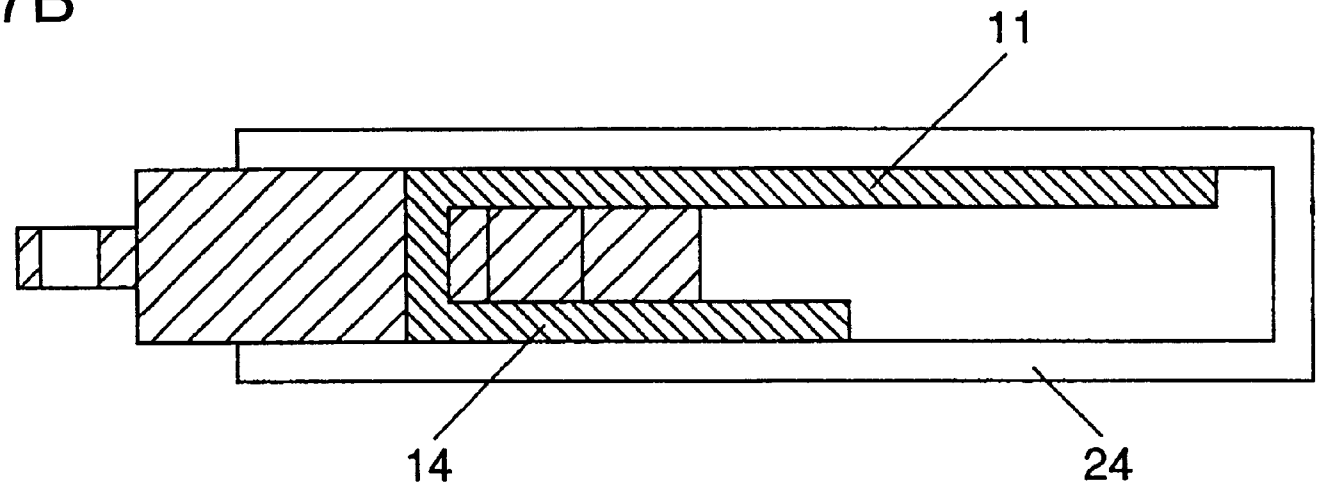

In FIG. 17A and FIG. 17B, the radiator 11 and the matching stub 14 do not contact with the radome 24. This structure, although making them hardly position in the holder 19 a little, prevents the radiator 11 and the matching stub 14 from contacting the radome 24 as much as possible even if the radome 24 is deformed by an external force. Therefore, this structure prevents the radiator 11 sustaining damage due to the deformation.

The radome 24 of the antenna device shown in FIG. 16A and FIG. 16B is preferably made of highly rigid material. In other words, the rigid radome 24 is hardly deformed and allows the radiator 11 to be affected from the deformation. In the antenna element shown in FIG. 17A and FIG. 17B, an external force via the radome 24 is unlikely to be applied to the radiator 11 even if the radome 24 is made of soft and easily-deformed material, since the radiator 11 does not contact with the radome 24.

Figure 18A:
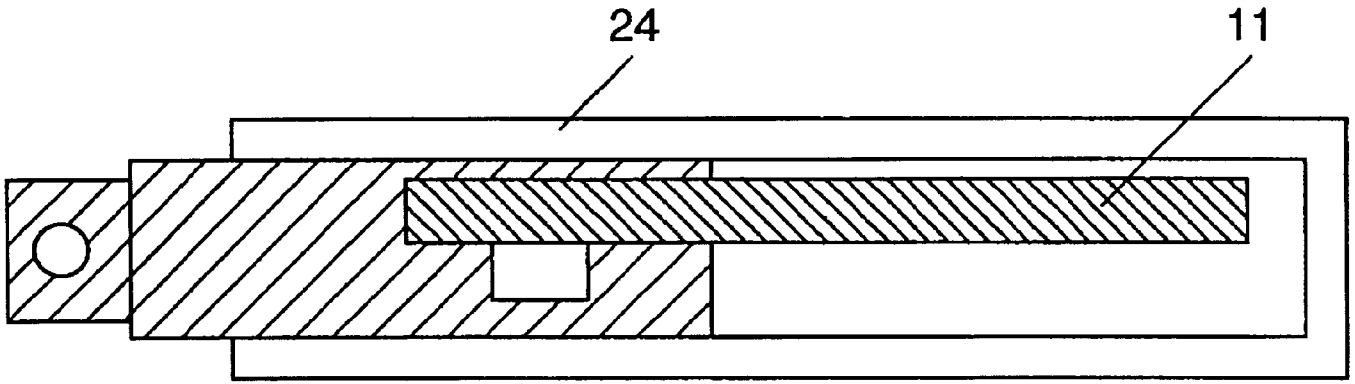
Figure 18B:
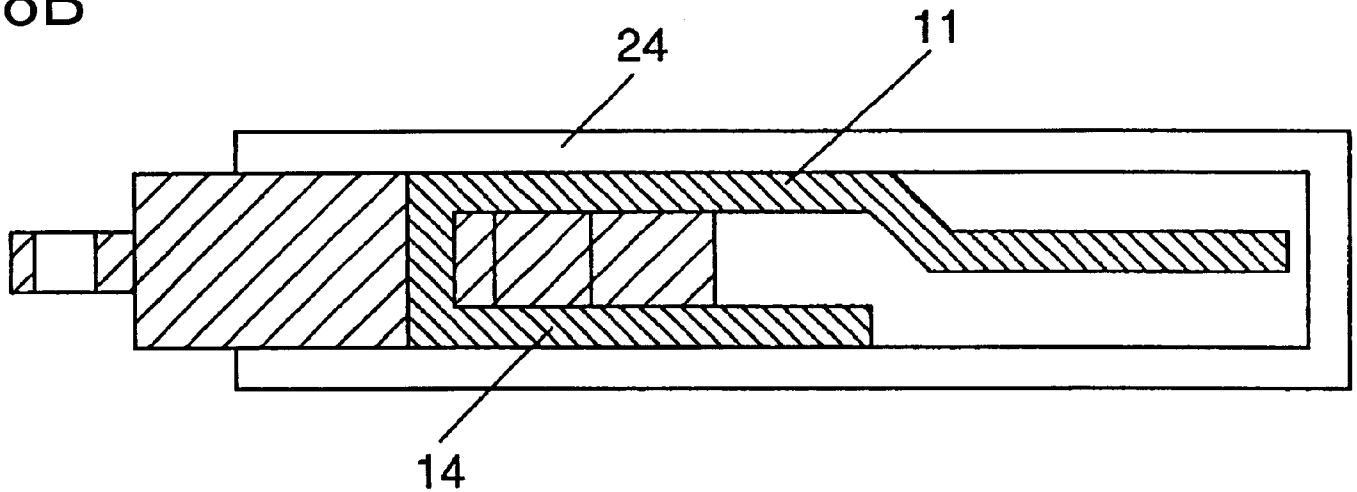

As shown in FIGS. 18A and 18B, when the radiator 11 has a bent section, a lower part of the radiator 11 and the matching stub 14 may preferably contact with the radome 24, but an upper part of the radiator 11 does not contact with the radome 24. In other words, the antenna element may be positioned when being inserted into the holder 19 in the manner that a part of the radiator 11 and the matching stub 14 contact with the radome 24. In addition, not contacting the upper part of the radiator 11, which influences to radiating characteristics, with the radome 24 secrely reduces any detrimental influence of the deformation of the radome 24 to the radiator 11.

Figure 19:
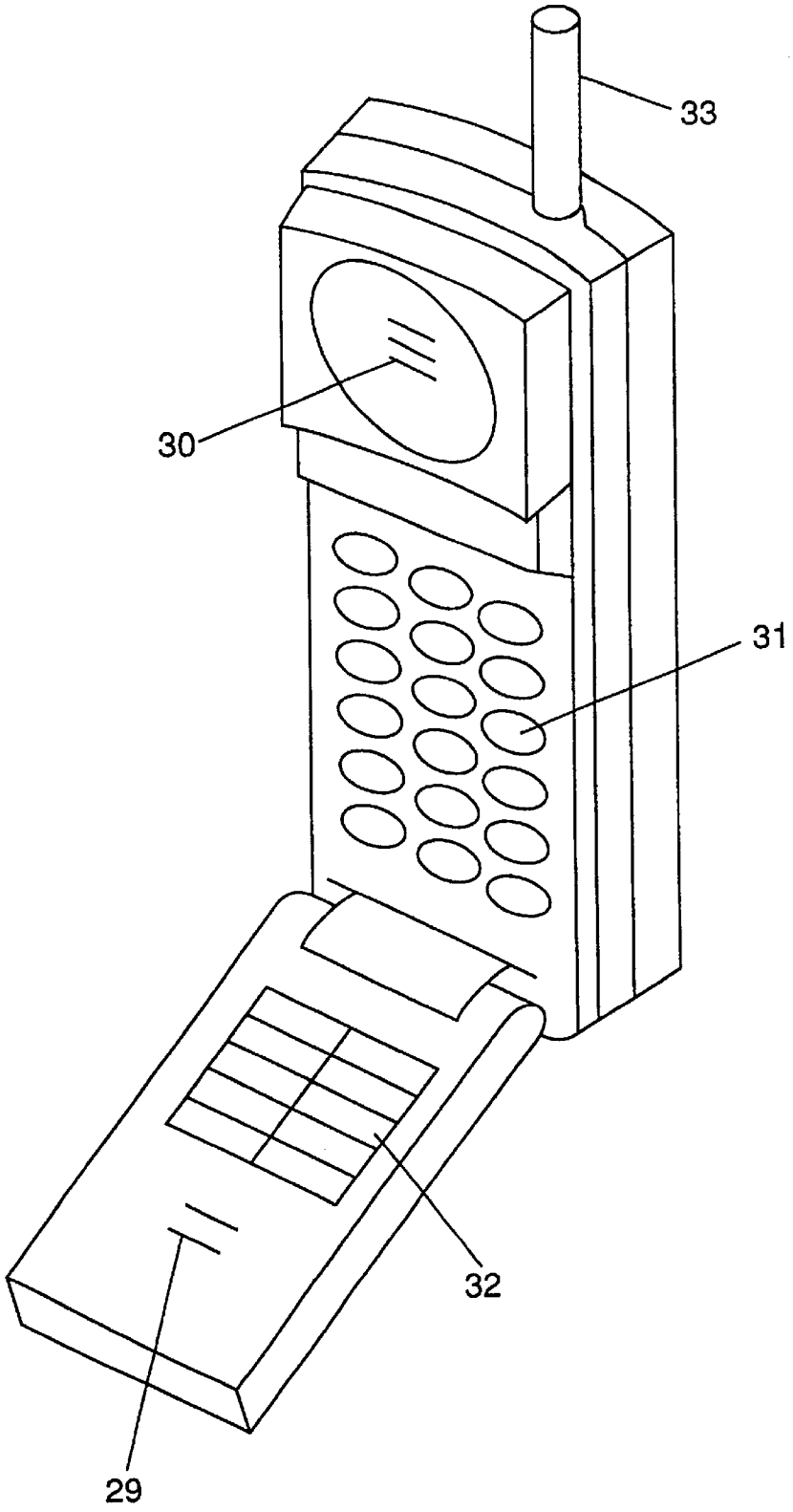
FIG. 19 is a perspective view of a mobile communication apparatus in accordance with the second embodiment.
Figure 20:
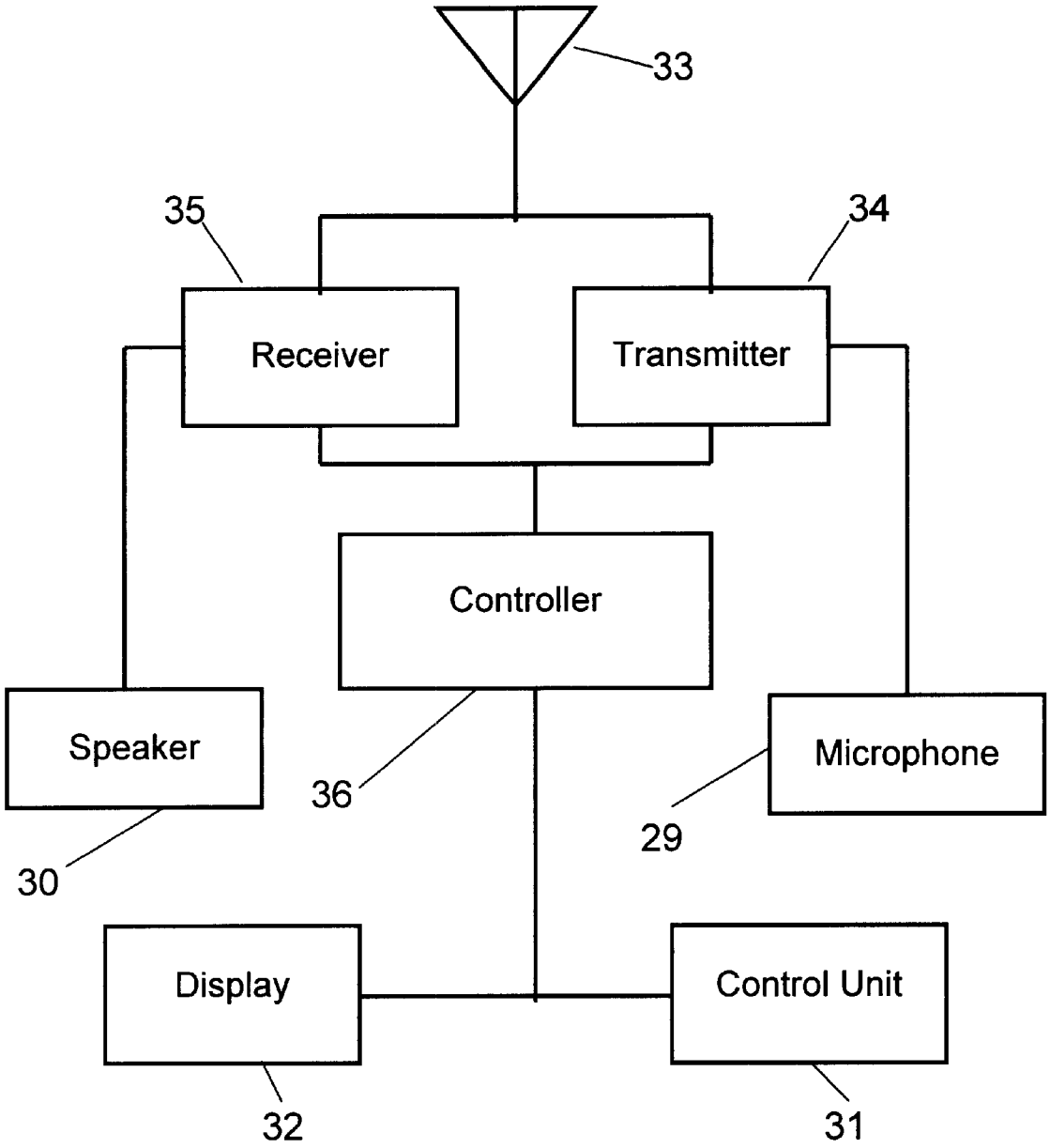
FIG. 20 is a block diagram of a mobile communication apparatus in accordance with the second embodiment.
Figure 21:
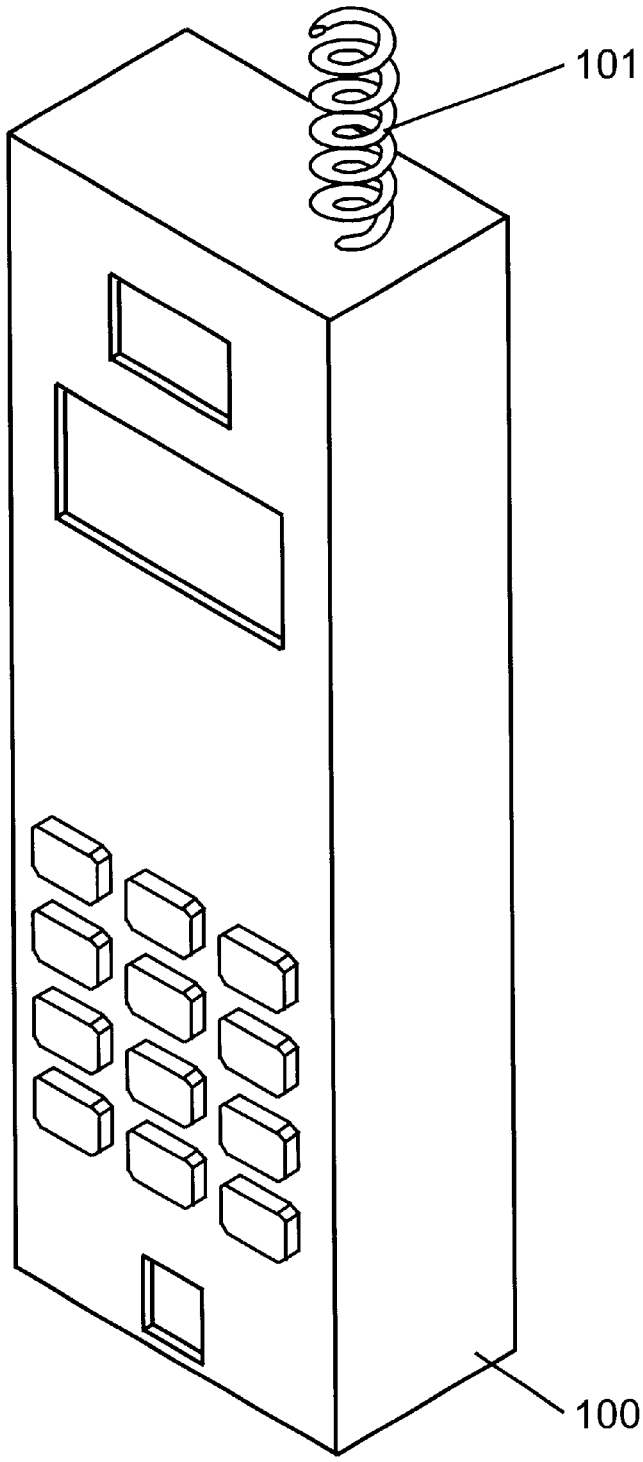
FIG. 21 is a perspective view of a conventional antenna device.
Figure 22:
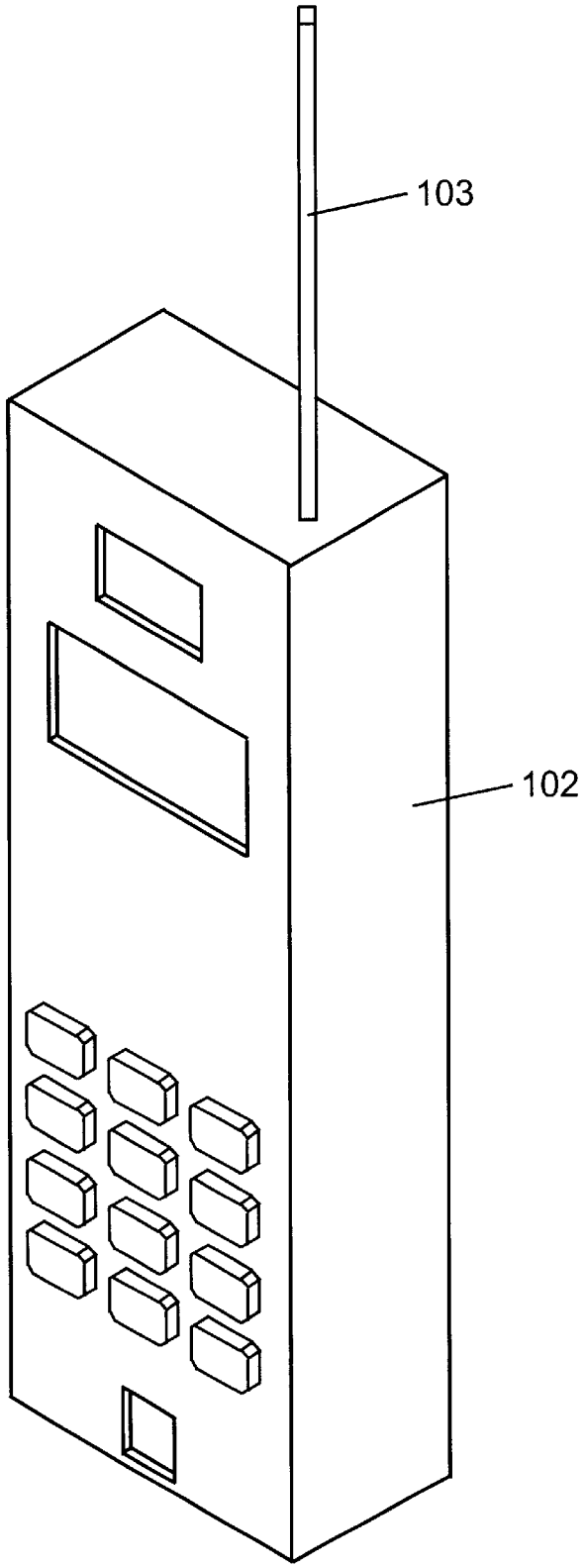
FIG. 22 is a perspective view of another conventional antenna device.

FIG. 19 and FIG. 20 are a perspective view and block diagram of a mobile communication apparatus in the first and second embodiments. The communication apparatus includes a microphone 29, a speaker 30, a control unit 31 including dialing buttons, a display 32 for displaying incoming calls, and an antenna device 33 shown in any of FIG. 1A to FIG. 18B. An antenna element is accommodated in the radome 24. A transmitter 34 demodulates an audio signal from the microphone 29 and converts it to a transmission signal. The transmission signal is emitted through the antenna device 33. A receiver 35 converts a received signal from the antenna device 33 to an audio signal. The audio signal is converted to voice in the speaker 30. A controller 36 controls the transmitter 34, receiver 35, control unit 31, and display 32.

An operation of the communication apparatus will be described below.

Upon receiving a call, the receiver 35 sends an arriving signal to the controller 36, and the controller 36 then displays a predetermined character on the display 32 based on the arriving signal. When a button for accepting the call on the control unit 31 is pressed, a signal corresponding to the button is sent to the controller 36. The controller 36 then sets each part to a receiving mode. More specifically, the signal received from the antenna device 33 is converted to an audio signal in the receiver 35, and the audio signal is output in voice form from the speaker 30. Voice input from the microphone 29 is then converted to an audio signal, which is emitted through the transmitter 34 and the antenna device 33.

For placing a call, a signal for transmission is input from the control unit 31 to the controller 36. Then, when a signal corresponding to a telephone number is sent from the control unit 31 to the controller 36, the controller 36 transmits the signal corresponding to the telephone number via the antenna device 33. When communications is established with a callee on the transmitted signal, a signal for establishing a call is sent to the receiver 35 and then sent to the controller 36 via the antenna device. The controller 36 then sets each part to a transmitting mode. More specifically, the signal received by the antenna device 33 is converted to an audio signal in the receiver 35, and the audio signal is output in voice form from the speaker 30. Voice input from the microphone 29 is then converted to an audio signal, which is emitted through the transmitter 34 and the antenna device 33.

The above describes the case of sending and receiving voice data. However, the present invention is not limited to the voice data. The same effect is obtainable in an apparatus which sends or receives data other than the voice data, such as character data and video data.

The radiator and the matching stub 14 in the antenna device 33 are preferably disposed in this order from the head of the user. In other words, the antenna device shown in FIG. 19 is preferably attached to the communication apparatus while the matching stub 2 or 14 is disposed at the opposite side of a surface where speaker 30 is mounted.

The mobile communication apparatus of the present invention reduces emissions of radio waves towards the user when the substantially-J-shaped antenna element having antenna characteristics prevented form degrading. The radiating characteristics of the antenna device are thus improved, and also at least one of the transmitting or receiving characteristics of the mobile communication apparatus are improved.

In the embodiments, the coaxial cable of the antenna device is electrically coupled to the circuitry in the mobile communication apparatus, so that the antenna device and mobile communication apparatus are attached similarly to the conventional antenna device.

What is claimed is:

1. An antenna device comprising:

a radiator having a line length L1;

a conductor having a line length L2, said conductor being disposed opposite to said radiator; and a feed point provided at said radiator, wherein the line length L1 and the line length L2 satisfy the following formula:

$$L1=0.75\lambda\pm0.2\lambda;\text{ and}$$

$$L2=0.25\lambda\pm0.2\lambda,$$

where λ is a wavelength of a signal applied to said radiator.

2. The antenna device as defined in claim 1, further comprising: a coupler for connecting respective ends of said radiator and said conductor.

3. The antenna device as defined in claim 2, wherein said coupler has a line length L3 satisfying:

$$\lambda/150\leq L3\leq\lambda/10.$$

4. The antenna device as defined in claim 2, wherein said radiator said conductor, and said coupler are unitarily formed.

5. The antenna device as defined in claim 4, wherein said radiator, said conductor, and said coupler are made of a metal sheet.

6. The antenna device as defined in claim 1, wherein said conductor has a shape substantially identical to a part, of said radiator, opposite to said conductor.

7. The antenna device as defined in claim 6, wherein said radiator includes a first meander portion.

8. The antenna device as defined in claim 7, wherein said first meander portion has a zigzag shape consisting of 1 to 9 substantially-U-shaped curves.

9. The antenna device as defined in claim 7, wherein a width of a slit provided in said first meander portion is 0.8 to 3 times of a width of said radiator.

10. The antenna device as defined in claim 7, wherein a corner of said first meander portion is chamfered.

11. The antenna device as defined in claim 7, wherein said radiator further includes a straight portion, and wherein said conductor is disposed opposite to said straight portion and not opposite to said first meander portion.

12. The antenna device as defined in claim 11, wherein said straight portion includes a bent section to locate said first meander portion close to said conductor.

13. The antenna device as defined in claim 7, wherein said conductor is disposed opposite to said first meander portion and includes a second meander portion.

14. The antenna device as defined in claim 13, wherein a corner of said second meander portion is chamfered.

15. The antenna device as defined in claim 13, wherein said radiator further includes a third meander portion.

16. The antenna device as defined in claim 15, wherein a corner of said third meander portion is chamfered.

17. The antenna device as defined in claim 1, wherein said radiator has a sheet shape having a thickness ranging from 0.1 mm to 3 mm.

18. The antenna device as defined in claim 1, wherein said radiator has a sheet shape having a width ranging from 0.5 mm to 6.0 mm.

19. The antenna device as defined in claim 1, wherein said conductor is a matching stub for adjusting impedance and for controlling directivity.

20. The antenna device as defined in claim 1, wherein said radiator is connected to a feed line of a coaxial cable, and said conductor is connected to a grounding line of the coaxial cable.

21. The antenna device as defined in claim 20, wherein said radiator includes a joint projecting on a side thereof, said joint being connected to the feed line.

22. The antenna device as defined in claim 21, wherein said joint has a through hole where the feed line passes.

23. A communication apparatus comprising:

an antenna device comprising:

a radiator having a line length L1;

a conductor having a line length L2, said conductor being disposed opposite to said radiator; and a feed point provided at said radiator;

a receiver for converting a signal received via said antenna device into at least one of an audio signal and data signal; and a transmitter for converting at least one of an audio signal and data signal into a signal, and sending the signal via said antenna device;

wherein the line length L1 and the line length L2 satisfy the following formula:

$$L1=0.75\lambda\pm0.2\lambda;\text{ and}$$

$$L2=0.25\lambda\pm0.2\lambda,$$

where λ is a wavelength of a signal applied to said radiator.

24. The antenna device as defined in claim 1, wherein said feed point is located between respective ends of said radiator and is not located at said respective ends.

25. The communication apparatus as defined in claim 23, wherein said feed point is located between respective ends of said radiator and is not located at said respective ends.

26. An antenna device comprising:

a radiator having a line length L1; and a conductor having a line length L2, said conductor being disposed opposite to said radiator;

wherein the line length L1 and the line length L2 satisfy the following formula:

$$L1=0.75\lambda\pm0.2\lambda;\text{ and}$$

$$L2=0.25\lambda\pm0.2\lambda,$$

where λ is a wavelength of a signal applied to said radiator, wherein said conductor has a shape substantially identical to a part, of said radiator, opposite to said conductor, wherein said radiator includes a first meander portion and a straight portion, and wherein said conductor is disposed opposite to said straight portion and not opposite to said first meander portion.

27. The antenna device as defined in claim 26, further comprising:

a coupler for connecting respective ends of said radiator and said conductor.

28. The antenna device as defined in claim 27, wherein said coupler has a line length L3 satisfying:

$$\lambda/150\leq L3\leq\lambda/10.$$

29. The antenna device as defined in claim 27, wherein said radiator, said conductor, and said coupler are unitarily formed.

30. The antenna device as defined in claim 29, wherein said radiator, said conductor, and said coupler are made of a metal sheet.

31. The antenna device as defined in claim 26, wherein said first meander portion has a zigzag shape consisting of 1 to 9 substantially-U-shaped curves.

32. The antenna device as defined in claim 26, wherein a width of a slit provided in said first meander portion is 0.8 to 3 times of a width of said radiator.

33. The antenna device as defined in claim 26, wherein a corner of said first meander portion is chamfered.

34. The antenna device as defined in claim 26, wherein said straight portion includes a bent section to locate said first meander portion close to said conductor.

35. The antenna device as defined in claim 26, wherein said conductor is disposed opposite to said first meander portion and includes a second meander portion.

36. The antenna device as defined in claim 35, wherein a corner of said second meander portion is chamfered.

37. The antenna device as defined in claim 35, wherein said radiator further includes a third meander portion.

38. The antenna device as defined in claim 37, wherein a corner of said third meander portion is chamfered.

39. The antenna device as defined in claim 26, wherein said radiator has a sheet shape having a thickness ranging from 0.1 mm to 3 mm.

40. The antenna device as defined in claim 26, wherein said radiator has a sheet shape having a width ranging from 0.5 mm to 6.0 mm.

41. The antenna device as defined in claim 26, wherein said conductor is a matching stab for adjusting impedance and for controlling directivity.

42. The antenna device as defined in claim 26, wherein said radiator is connected to a feed line of a coaxial cable, and said conductor is connected to a grounding line of the coaxial cable.

43. The antenna device as defined in claim 42, wherein said radiator includes a joint projecting on a side thereof, said joint being connected to the feed line.

44. The antenna device as defined in claim 43, wherein said joint has a through hole where the feed line passes.

45. The antenna device as defined in claim 26, further comprising a feed point located between respective ends of said radiator and not located at said respective ends.

46. An antenna device comprising:

a radiator having a line length L1; and a conductor having a line length L2, said conductor being disposed opposite to said radiator;

wherein the line length L1 and the line length L2 satisfy the following formula:

$$L1=0.75\lambda\pm0.2\lambda;\text{ and}$$

$$L2=0.25\lambda\pm0.2\lambda,$$

where λ is a wavelength of a signal applied to said radiator, wherein said conductor has a shape substantially identical to a part, of said radiator, opposite to said conductor, wherein said radiator includes a first meander portion and a second meander portion, and wherein said conductor is disposed opposite to said first meander portion and includes a third meander portion.

47. The antenna device as defined in claim 46, further comprising:

a coupler for connecting respective ends of said radiator and said conductor.

48. The antenna device as defined in claim 47, wherein said coupler has a line length L3 satisfying:

$$\lambda/150\leqq L3\leqq\lambda10.$$

49. The antenna device as defined in claim 47, wherein said radiator, said conductor, and said coupler are unitarily formed.

50. The antenna device as defined in claim 49, wherein said radiator, said conductor, and said coupler are made of a metal sheet.

51. The antenna device as defined in claim 46, wherein said first meander portion has a zigzag shape consisting of 1 to 9 substantially-U-shaped curves.

52. The antenna device as defined in claim 46, wherein a width of a slit provided in said first meander portion is 0.8 to 3 times of a width of said radiator.

53. The antenna device as defined in claim 46, wherein a corner of said first meander portion is chamfered.

54. The antenna device as defined in claim 46, wherein said radiator further includes a straight portion, and wherein said conductor is disposed opposite to said straight portion and not opposite to said first meander portion.

55. The antenna device as defined in claim 54, wherein said straight portion includes a bent section to locate said first meander portion close to said conductor.

56. The antenna device as defined in claim 46, wherein a corner of said third meander portion is chamfered.

57. The antenna device as defined in claim 46, wherein a corner of said second meander portion is chamfered.

58. The antenna device as defined in claim 46, wherein said radiator has a sheet shape having a thickness ranging from 0.1 mm to 3 mm.

59. The antenna device as defined in claim 46, wherein said radiator has a sheet shape having a width ranging from 0.5 mm to 6.0 mm.

60. The antenna device as defined in claim 46, wherein said conductor is a matching stab for adjusting impedance and for controlling directivity.

61. The antenna device as defined in claim 46, wherein said radiator is connected to a feed line of a coaxial cable, and said conductor is connected to a grounding line of the coaxial cable.

62. The antenna device as defined in claim 61, wherein said radiator includes a joint projecting on a side thereof, said joint being connected to the feed line.

63. The antenna device as defined in claim 62, wherein said joint has a through hole where the feed line passes.

64. The antenna device as defined in claim 46, further comprising a feed point located between respective ends of said radiator and not located at said respective ends.

65. An antenna device comprising:

a radiator having a line length L1; and a conductor having a line length L2, said conductor being disposed opposite to said radiator;

wherein the line length L1 and the line length L2 satisfy the following formula:

$$L1=0.75\lambda\pm0.2\lambda;\text{ and}$$

$$L2=0.25\lambda\pm0.2\lambda,$$

where λ is a wavelength of a signal applied to said radiator, wherein said radiator is connected to a feed line of a coaxial cable, and said conductor is connected to a grounding line of the coaxial cable, and wherein said radiator includes a joint projecting on a side thereof, said joint being connected to the feed line.

66. The antenna device as defined in claim 65, further comprising:

a coupler for connecting respective ends of said radiator and said conductor.

67. The antenna device as defined in claim 66, wherein said coupler has a line length L3 satisfying:

$$\lambda/150\leqq L3\leqq\lambda/10.$$

68. The antenna device as defined in claim 66, wherein said radiator, said conductor, and said coupler are unitarily formed.

69. The antenna device as defined in claim 68, wherein said radiator, said conductor, and said coupler are made of a metal sheet.

70. The antenna device as defined in claim 65, wherein said conductor has a shape substantially identical to a part, of said radiator, opposite to said conductor.

71. The antenna device as defined in claim 70, wherein said radiator includes a first meander portion.

72. The antenna device as defined in claim 71, wherein said first meander portion has a zigzag shape consisting of 1 to 9 substantially-U-shaped curves.

73. The antenna device as defined in claim 71, wherein a width of a slit provided in said first meander portion is 0.8 to 3 times of a width of said radiator.

74. The antenna device as defined in claim 71, wherein a corner of said first meander portion is chamfered.

75. The antenna device as defined in claim 71, wherein said radiator further includes a straight portion, and wherein said conductor is disposed opposite to said straight portion and not opposite to said first meander portion.

76. The antenna device as defined in claim 75, wherein said straight portion includes a bent section to locate said first meander portion close to said conductor.

77. The antenna device as defined in claim 71, wherein said conductor is disposed opposite to said first meander portion and includes a second meander portion.

78. The antenna device as defined in claim 77, wherein a corner of said second meander portion is chamfered.

79. The antenna device as defined in claim 77, wherein said radiator further includes a third meander portion.

80. The antenna device as defined in claim 79, wherein a corner of said third meander portion is chamfered.

81. The antenna device as defined in claim 65, wherein said radiator has a sheet shape having a thickness ranging from 0.1 mm to 3 mm.

82. The antenna device as defined in claim 65, wherein said radiator has a sheet shape having a width ranging from 0.5 mm to 6.0 mm.

83. The antenna device as defined in claim 65, wherein said conductor is a matching stab for adjusting impedance and for controlling directivity.

84. The antenna device as defined in claim 65, wherein said joint has a through hole where the feed line passes.

85. The antenna device as defined in claim 65, further comprising a feed point located between respective ends of said radiator and not located at said respective ends.

* * * * *